United States Patent [19]

Maston

[11] 3,953,062

[45] Apr. 27, 1976

[54] PADLOCK CLASP

[76] Inventor: John F. Maston, 1045 Naranca, El Cajon, Calif. 92021

[22] Filed: June 10, 1975

[21] Appl. No.: 585,477

[52] U.S. Cl. ..... 292/57; 70/56; 70/128

[51] Int. Cl.[2] ..... E05C 5/02

[58] Field of Search ..... 292/57, 58, 281; 70/54, 70/55, 56, 128, 417, 81, 83, 90, 418

[56] References Cited

UNITED STATES PATENTS

| | | | |
|---|---|---|---|
| 708,892 | 9/1902 | Long | 70/128 |
| 1,262,809 | 4/1918 | Kolody | 292/57 |
| 2,114,913 | 4/1938 | Crossman | 70/56 |
| 3,599,453 | 8/1971 | Bouernfeind | 70/129 |
| 3,652,114 | 3/1972 | Cady | 70/56 X |
| 3,718,014 | 2/1973 | Delgadillo | 70/56 |

*Primary Examiner*—Robert L. Wolfe
*Attorney, Agent, or Firm*—Brown & Martin

[57] ABSTRACT

A clasp having a rigid backplate with one side projecting outwardly to enclose the latching side of a locking padlock. The other side of the backplate is similarily outwardly turned, and a bolt is slidably and pivotally positioned in aligned holes in the outwardly turned sides. A front plate is welded to the bolt and a bale support member is welded orthogonally to the inside face of the front plate. A matching bale support member is welded to the back plate and when the clasp is closed, the two bale support members are aligned. The bale of the padlock is received in holes in the bale support members. In the locked position, the front plate and the proximate side of the back plate prevents the application of a downward blow on the side of the padlock that includes the latch mechanism. The clearance between the front plate and the proximate side is insufficient for the insertion of a punch or other object for striking a blow against the locking side of the padlock. Also the clearance between the front plate and the distal side is insufficient to permit access of a bolt cutter or snips to the padlock bale. The front plate is welded to the bolt, and the bale support members are welded to the front plate and back plate respectively, such that the strong side of each weld provides the only possible access for a punch or other similar blow striking instruments.

10 Claims, 6 Drawing Figures

PADLOCK CLASP

BACKGROUND OF THE INVENTION

Padlocks having U-shaped bales are primarily used for locking garage doors, barn doors, storage sheds and other similar enclosures. Most padlocks are characterized by a bale, the ends of which are slidably received in the lock body. One end of the bale is characterized by a hook or catch, and in the locked position a latch enclosed within the padlock body is received in the catch and holds the bale in the locked position. The other end of the bale is permanently held within the padlock body.

Padlocks, even of substantial size and durability, have generally proven quite susceptible to opening by several means. A most common method of breaking the padlock is to utilize a heavy duty snips or bolt cutter to break or cut the bale. This is a most effective method and requires little noise or other warning associated with a surreptitious entry. It has also been found that delivering a substantial blow, such as by means of a punch, may cause separation of the latch and catch mechanism and consequently, release the bale. It has also been found that blows inflicted on the latching side of the padlock in the downward direction are effective in releasing the bale. Blows inflicted on the other side of the padlock have generally been ineffective to break the latch and catch connection.

In most uses of padlocks, a pair of bale support members are connected to a door adjacent the door frame. A bolt is slidably received in brackets adjacent the door frame and is adapted for reception in a hole in the door frame. The bolt includes a loop, that in the locked position is designed to fit about a bale support member. The bale of the padlock is received through a hole in the bale support member confining the loop between the bale and the door. This arrangement provides very little security since the bale is readily accessible by snips or a bolt cutter, and it is also possible to inflict a downward blow on the latching side of the padlock.

Various clasps have been used over the years to protect against the unwanted breaking of a padlock. For several reasons, none have proven adequate. There usually exists a means to circumvent the clasp, or the device leaves the weak points of the padlock insufficiently protected. Furthermore, the clasps in the prior art have themselves proven to be penetratable and consequently, render the padlock vulnerable to forced breaking. Therefore, there has been a substantial need to provide a padlock clasp that protects the padlock from breaking by means of a blow to the padlock body, or the cutting of the bale by means of a bolt cutter. The need extends to provision of a clasp that is structurally rigid and durable, and is not vulnerable to destruction.

SUMMARY OF THE INVENTION

It is an object of the invention to provide a new and improved padlock clasp.

Another object of the invention is to provide a new and improved padlock clasp that prevents the application of a blow to the padlock that would ordinarily release the bale.

Another object of the invention is to provide a new and improved padlock clasp that prevents snips from access to the bale of the padlock.

Another object of the invention is to provide a new and improved padlock clasp that prevents snips from access to the bale of the padlock, but at the same time, permits the padlock to be manipulated for removal from the clasp when it is unlocked.

Another object of the invention is to provide a new and improved padlock clasp that prevents a punch from penetrating the clasp for application of a blow on the latching side of the padlock.

Another object of the invention is to provide a new and improved padlock clasp in which the strong weld sides only of the clasp components are accessible by blow inflicting instruments.

Another object of the invention is to provide a new and improved padlock clasp having a bolt slidably received in a hole in the door frame.

Another object of the invention is to provide a new and improved padlock clasp of rigid and durable construction and characterized by a positive locking and unlocking motion.

The clasp is bolted to a door adjacent the door frame. A structurally rigid back plate includes a pair of bolt holes through which a bolt is received for insertion in a hole in the door frame. The back plate, in the vicinity of a proximate side, is bent outwardly and extends a distance approximately equal to the thickness of a padlock. The distal side of the back plate is similarily bent outwardly and aligned holes are formed in the proximate and distal sides through which the bolt is slidably received.

A front plate is welded to the bolt and the bolt is slidable between locked and unlocked positions. The front plate includes a back part that is welded to the bolt and a front part that in the closed position is parallel to the back plate and spaced therefrom a distance approximately equal to the width of the padlock.

A bale support member is welded to the inside face of the front plate and a similar bale support member is welded to the back plate. In the locked position, the bale support members are aligned and slotted holes in each of the members receive the bale of the padlock. The front plate in combination with the proximate side of the back plate enclose the latching side of the padlock and prevent that side from being struck in a downward direction. The clearance between that front plate and the proximate side is insufficient for a punch or other similar instrument to contact the latching side of the padlock for the purpose of striking a blow. Also, in the closed position, the clearance between the front plate and the distal side is insufficient for the jaws of a bolt cutter or snips to grasp the bale for the purpose of cutting the same. That clearance, however, is sufficient to permit an unlocked padlock to be manipulated and angled for its removal.

The entire clasp is fabricated from a rigid and durable metal plate to resist destruction thereof to gain access to the padlock. Furthermore, the front plate and the bale support members are welded to the bolt, front plate and back plate respectively such that only the strong side of the weld is accessible by a punch or other impact inflicting instrument. This provides the clasp with additional rigidity since it is substantially more difficult to bend a piece of metal away from its weld than it is toward its weld.

The above and other objects of the invention will be apparent as the description continues and when read in conjunction with the appended drawings.

DETAILED DESCRIPTION OF THE DRAWINGS

Figure 1:
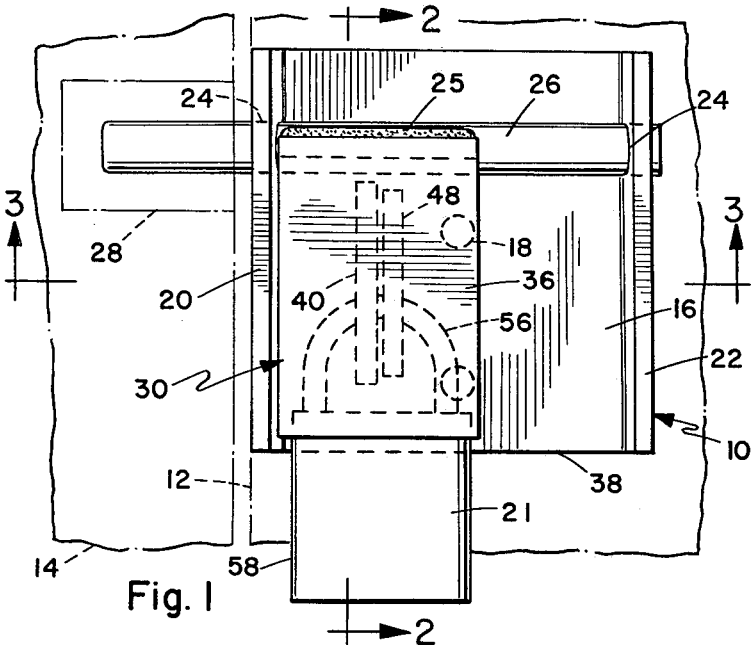
FIG. 1 is a front elevation view of the clasp in closed and locked position.
Figure 2:
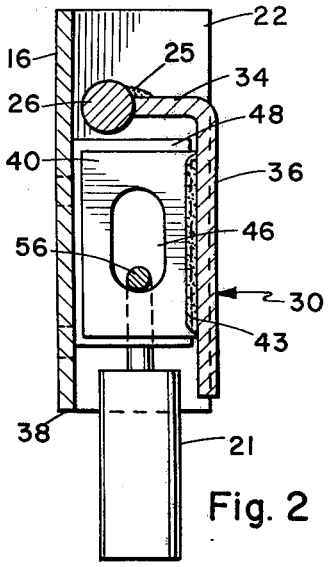
FIG. 2 is a sectional view taken on line 2—2 of FIG. 1.
Figure 3:
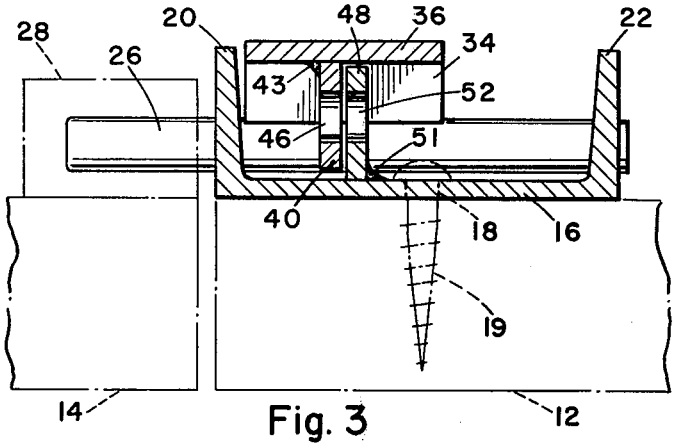
FIG. 3 is a sectional view taken on line 3—3 of FIG. 1.
Figure 4:
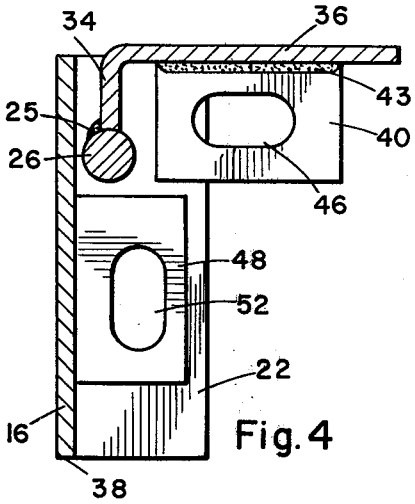
FIG. 4 is a sectional view similar to FIG. 2, but with the clasp in the open position.
Figure 5:
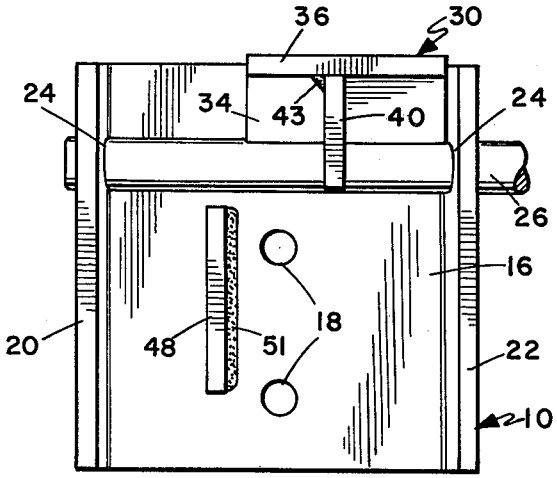
FIG. 5 is a front elevation view of the clasp open as in FIG. 4.
Figure 6:
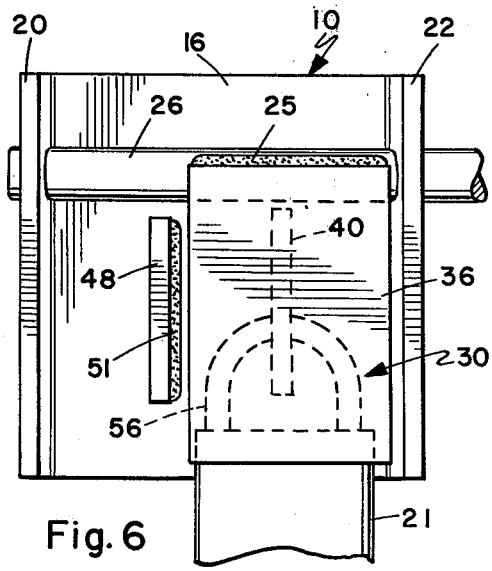
FIG. 6 is a front elevation view of the clasp in closed, but unlocked position.

As illustrated in the drawings, the clasp 10 is assembled to a door 12 in the vicinity of the door frame 14. The clasp 10 is defined by a structurally rigid back plate 16. Bolt holes 18 are formed in the back plate 16 and the bolts 19 fasten the clasp 10 to the door 12.

The back plate 16 has a side section 20 that is proximate with respect to the door frame 14. Proximate side 20 is bent outwardly, extending a distance approximately equal to the thickness of padlock 21. The side section 22, distal from the door frame 14, is similarily bent outwardly to form an essentially U-shaped back plate 16. Aligned holes 24 are formed in the upper part of both the proximate and distal sides 20, 22 and a bolt 26 is slidably received in those holes. A socket member 28 is fixed in the door frame 14 as shown, or may be inset in the frame, and when the clasp 10 is closed the bolt 26 is received in the socket member 28 to maintain the door 12 in a locked position.

A front plate 30 is welded to the bolt 26, the weld 25 being made along the exterior facing edge of its back part 34. In the closed position, the back part 34 extends outwardly from the door 12. An integral forward part 36 depends downwardly from the back part 34. The forward part 36 and the bottom edge 38 of the back plate 16, terminates in approximately the same plane.

A generally rectangular bale support member 40 is welded to the forward part 36, the weld 43 being to the inside face of the forward part 36. The weld 43 is made edgewise on the proximate face of bale support member 40. A hole or slot 46 is formed substantially centrally in the bale support member 40. A similar bale support member 48 is connected to the back plate 16 and extends outwardly therefrom. The weld 51 is made edgewise on the distal face of member 48. The bale support member 48 includes a central slot 52. When the clasp 10 is in the locked position, the bale support members 40, 48 are in substantial alignment and the slots 46, 52 are also aligned.

In utilizing the clasp 10, padlock 21 has its bale 56 inserted in the slots 46, 52. The latching side 58 of the padlock 21 is disposed toward the proximate side 20. As illustrated in the drawings, in the closed position the clearance between the forward part 36 and the proximate side 20 is insufficient to permit the passge therethrough of a punch or other instrument to impart a downward blow to the padlock 21. The only way to break the latch of padlock 21 is by inflicting a substantial downward blow on the latching side 58 of the padlock 21. The clearance between the forward part 36 and the distal section 22 will permit the penetration of a punch for application of a downward blow on the other side 55 of the padlock 21. However, the padlock

21 construction does not permit release of its bale 56 due to a blow struck on side 55 of the padlock 21. Thus, the structure of the clasp 10 thus far defined, renders the padlock 21 secure against breaking the lock at least as far as removing the bale 56 from the padlock body is concerned.

The clearance between the forward part 36 and the distal side 22 is insufficient to permit access by the jaws of a snips or bolt cutter to the bale 56. The snips necessary to cut the bale 56 are generally too massive to be received in the clearance between the forward part 36 and the distal side 22. However, distance between the bale support member 48 and the distal side 22 is sufficient to permit the open padlock 21 to be manipulated so as to withdraw the bale 56 from the slots 46, 52. Therefore, the clasp 10 as defined herein, permits removal of an open padlock 21 but prevents the cutting of the bale 56 by means of a snips. In order to prevent unintentional closing of the clasp 10, the padlock 21 may be stored by supporting the bale 56 in either of the slots 46, 52.

The clasp 10 thus far defined will secure a padlock 21 against unwanted breaking by means of blows inflicted on the latching side 58 as well as by cutting the bale 56. The padlock 21 however, is only as secure as the clasp 10 is against destructive punching or impacting. It is known that it is substantially more difficult to bend or break a piece of metal by bending away from a weld that it is by bending toward or over a weld. Inspection of the welding of the bale support members 40, 48 reveals that for a punch or similar instrument to break the support members 40, 48, it would be required to break at least one bale support member by bending it away from its weld. An inspection of the drawings reveals that if a punch were used to break the bale support members 40, 48 by striking from the distal side 22 toward the proximate side 20, the bale support member 48 would have to be broken against the resistance of the strong side of the weld 51. Conversely, if breakage is attempted from the proximate side 20 toward the distal side 22, bale support member 40 would have to be broken against the resistance of the strong side of its weld 43. Inspection of the front plate 30 reveals a similar situation. A punch placed against the back part 34 would inflict a downward blow on that back part. This would have a tendency to bend the back part away from its weld 25. As previously stated, this is the strong side of the weld 25 and it will resist breaking. In the event it is attempted to break the front plate 30 by means of an upward blow on that front plate 30, it should be evident that the bale support members 40, 48 in conjunction with the bale 56 will resist the upward thrust of that front plate 30. Thus, the clasp 10 protects the padlock 21 from being broken, and is itself substantially invulnerable to penetration.

In using the clasp 10, the front plate 30 is pivoted about the bolt 26 from its normally open or distal position, to its closed or proximate position, wherein the forward part 36 is substantially parallel to the back plate 16. The bale 56 of the padlock 21 is then inserted in the slots 46, 52 and the padlock 21 is latched in the normal manner. To remove the padlock 21, its latch is released and it is manipulated until the bale 56 can be withdrawn from the slots 46, 52. This is done by pivoting the bale 56 into the area adjacent the distal side 22 and removing it from slots 46, 52. To open the door 12, the front plate 30 is then pivoted about the bolt 26 and that bolt 26 is then withdrawn from the socket member 28, and the front plate 30 is moved to adjacent the distal side 22.

Having described my invention, I now claim.

1. A clasp for being connected to a door and lockable by a padlock, which clasp comprises:

a back plate member for being connected to the door adjacent the door frame, a bolt slidably mounted in said back plate member and movable between door locked and door unlocked positions, said bolt received in an opening in the door frame in the door locked position, a front plate member connected to said bolt and overlying at least a part of the padlock in the door locked position, a first padlock bale support member connected to said back plate member and extending outwardly toward said front plate member and having a hole to receive the bale, a second bale support member connected to said front plate member and extending toward said back plate member and having a hole to receive the bale, and said holes in said first and second bale support members aligned for the mutual reception of the bale when the padlock is locked.

2. The clasp of claim 1 wherein:

a proximate side of said back plate, adjacent the door frame, protrudes outwardly from said door and in combination with said front plate forms an enclosure that prevents application of a downward blow on the latching side of the padlock.

3. The clasp of claim 2, wherein:

said proximate side of said back plate and an adjacent edge of said front plate, in the locked position, are separated by a clearance insufficient to pass an impact instrument to impart a downward blow on the latching side of the padlock.

4. The clasp of claim 2, wherein:

a distal side of said back plate protrudes outwardly from said door, the clearance between said distal side and said front plate is insufficient to permit access by jaws of a snips to the padlock bale, and said clearance is sufficient for orienting the padlock in the unlocked position to free the bale from said holes in said bale support members.

5. The clasp of claim 4 wherein:

said first bale support member is welded on a distal edge thereof to said back plate member.

6. The clasp of claim 2, wherein:

said second bale support member is welded on a proximate edge thereof to said front plate member.

7. The clasp of claim 1, wherein:

said front plate member comprises a rear part exteriorly edgewise welded to said bolt, a forward part angularly connected to said rear part, and said second bale support member is welded to an interior face of said forward part.

8. The clasp of claim 1, wherein:

said back plate has holes formed therein for bolting said clasp to the door.

9. The clasp of claim 1, wherein:

said bale support members are contoured for substantial alignment in the locked position, and in said locked position said front plate is disposed parallel to said back plate.

10. The clasp of claim 4, wherein:

the proximate and distal sides of said back plate have aligned holes to slidably receive said bolt.

* * * * *